US007277855B1

(12) United States Patent
Acker et al.

(10) Patent No.: US 7,277,855 B1
(45) Date of Patent: Oct. 2, 2007

(54) PERSONALIZED TEXT-TO-SPEECH SERVICES

(75) Inventors: Edmund Gale Acker, Colts Neck, NJ (US); Frederick Murray Burg, West Long Branch, NJ (US)

(73) Assignee: AT&T Corp., New York, NY (US)

( * ) Notice: Subject to any disclaimer, the term of this patent is extended or adjusted under 35 U.S.C. 154(b) by 821 days.

(21) Appl. No.: 09/793,168

(22) Filed: Feb. 26, 2001

Related U.S. Application Data

(63) Continuation-in-part of application No. 09/608,210, filed on Jun. 30, 2000.

(51) Int. Cl.
*G10L 13/00* (2006.01)

(52) U.S. Cl. ..... 704/260; 704/270.1

(58) Field of Classification Search ..... 704/201, 704/260, 270, 270.1, 271, 277; 379/88.12, 379/88.13, 88.16, 67.1
See application file for complete search history.

(56) References Cited

U.S. PATENT DOCUMENTS 5,812,126 A * 9/1998 Richardson et al. ..... 715/741
5,995,590 A * 11/1999 Brunet et al. ..... 379/52
6,035,273 A * 3/2000 Spies ..... 704/270

OTHER PUBLICATIONS

AT&T Labs—Research—http://www.research.att.com/projects/tts/.
M. Beutnagel, M. Mohri, M. Riley; Rapid Unit Selection From a Large Speech Corpus For Concatenative Speech Synthesis; Sep. 1999; Eurospeech '99 Budapest, Hungary.
M. Beutnagel, A. Conkie; Interaction Of Units In A Unit Selection Database; Sep. 1999; Eurospeech '99 Budapest, Hungary.
M. Beutnagel, A. Conkie, J. Schroeter, Y. Stylianou, A. Syrdal; The AT&T Next-Gen TTS System; Joint Meting of ASA, EAA, and DAGA, Berlin, Germany, Mar. 15-19, 1999, Paper 2ASCA-4.
Y. Stylianou; Analysis of Voiced Speech Using Harmonic Models; Joint Meeting of ASA, EAA and DAGA, Berlin, Germany, Mar. 15-19, 1999, Paper 5ASCA-2.
A. Conkie, Robust Unit Selection System For Speech Synthesis; Joint Meeting of ASA, EAA and DAGA, Berlin, Germany, Mar. 15-19, 1999, Paper 1PSCB-10.
Y. Stylianou, Assessment and Correction of Voice Quality Variabilities in Large Speech Databases for Concatenative Speech Synthesis; ICASSP-99, Phoenix, Arizona, Mar. 1999.

* cited by examiner

*Primary Examiner*—Angela Armstrong

(57) ABSTRACT

A personalized text-to-speech (pTTS) system provides a method for converting text data to speech data utilizing a pTTS template representing the voice characteristics of an individual. A memory stores executable program code that converts text data to speech data. Text data represents a textual message directed to a system user and speech data represents a spoken form of text data having the characteristics of an individual's voice. A processor executes the program code, and a storage device stores a pTTS template and may store speech data. The pTTS system can be used to provide various services that provide immediate spoken presentation of the speech data converted from text data and/or combine stored speech data with generated speech data for spoken presentation.

36 Claims, 7 Drawing Sheets

PERSONALIZED TEXT-TO-SPEECH SERVICES

This is a continuation in part of patent application Ser. No. 09/608,210, filed Jun. 30, 2000.

FIELD OF THE INVENTION

The present invention relates to text-to-speech conversion, and, more particularly, is directed to services using a template for personalized text-to-speech conversion.

BACKGROUND OF THE INVENTION

Text-To-Speech (TTS) systems for converting text into synthesized speech are entering the mainstream of advanced telecommunications applications. A typical TTS system proceeds through several steps for converting text into synthesized speech. First, a TTS system may include a text normalization procedure for processing input text into a standardized format. The TTS system may perform linguistic processing, such as syntactic analysis, word pronunciation, and prosodic prediction including phrasing and accentuation. Next, the system performs a prosody generation procedure, which involves translation between the symbolic text representation to numerical values of a fundamental frequency, duration, and amplitude. Thereafter, speech is synthesized using a speech database or template comprising concatenation of a small set of controlled units, such as diphones. Increasing the size and complexity of the speech template may provide improved speech synthesis. Examples of TTS systems are described in U.S. Pat. No. 6,003,005, entitled "Text-To-Speech System And A Method And Apparatus For Training The Same Based Upon Intonational Feature Annotations Of Input Text", and U.S. Pat. No. 5,774,854, entitled "Text To Speech System", which are hereby incorporated by reference. Additional information about TTS systems may be found in "Talking Machines: Theories, Models and Designs", ed G. Bailly and C. Benuit, North Holland (Elsevier), 1992.

SUMMARY

In accordance with an aspect of this invention, there are provided a method of and a system for providing services using a template for personalized text-to-speech conversion.

In general, in a first aspect, the invention features a method for converting text to speech, including receiving data representing a textual message that is directed from an author to a recipient, receiving information identifying an individual, retrieving a speech template comprising information representing characteristics of the individual's voice, and converting the data representing the textual message to speech data. The speech data represents a spoken form of the textual message having the characteristics of the individual's voice.

In a second aspect, the invention features a text to speech conversion system, including a memory that stores executable program code, a processor that executes the program code, and a storage device that stores a speech template comprising information representing characteristics of the individual's voice. The individual is identified by identification data. The program code is executable to convert text data to speech data. The text data represents a textual message directed from an author to a recipient, and the speech data represents a spoken form of the text data having the characteristics of the individual's voice.

In a third aspect, the invention features an article of manufacture including a computer readable medium having computer usable program code embodied therein. The computer usable program code contains executable instructions that when executed, cause a computer to perform the methods described herein.

In a fourth aspect, the invention features a method for generating speech data for a voice response system, including receiving input from a recipient, generating a text message that provides a response to the input, selecting a speech template comprising information representing characteristics of a voice based at least in part on attributes of the recipient such as age or gender, and converting the text message to speech data. The speech data represents a spoken form of the textual message having the characteristics of the voice.

In a fifth aspect, the invention features a method for converting chat room text to speech, including storing a plurality of speech templates, each speech template comprising information representing characteristics of a chat room participant's voice, receiving the chat room text from an author who is a chat room participant, retrieving a speech template comprising information representing characteristics of the author's voice from the plurality of speech templates, and converting the chat room text to speech data. The speech data represents a spoken form of the textual message having the characteristics of the author's voice.

In a sixth aspect, the invention features a method for providing spoken electronic mail, including receiving an electronic text message addressed to a recipient from an author of the message, retrieving a speech template comprising information representing characteristics of the author's voice, converting the text message to speech data representing a spoken form of the textual message having the characteristics of the author's voice, and directing the speech data to the recipient.

In a seventh aspect, the invention features a method for providing speech output from a software application, including receiving text data from the software application, receiving information identifying an individual, retrieving a speech template comprising information representing characteristics of the individual's voice, converting the text data to speech data representing a spoken form of the text data having the characteristics of the individual's voice, and supplying the speech data to an output device for output to a user as audio information. The software application may comprise an interactive learning program.

Preferred embodiments of the invention additionally feature the author interacting with a first computer and the recipient interacting with a second computer which is coupled to the first computer through a data network. The speech template may be provided at a central location coupled to the first and second computers. Text data may be received at the central location from either the first or second computer, and the speech data may be transmitted to the first or second computer from the central location. Alternatively, the speech template may be provided at the first computer, and either the speech data or the speech template may be transmitted to second computer from the first computer. Alternatively, the speech template may be provided at the second computer, and the data representing the textual message may be received at the second computer.

In other embodiments, the first and second computers may communicate in an instant messaging format, or they may be coupled to a server configured to operate chat room software, with the text data comprising text input to the chat room. The server may store speech templates for users of the chat room. The first and second computers may be coupled to a server adapted to store and provide access to a shared space object that is associated with the textual message. The data representing the textual message may also be an e-mail message.

In other embodiments, the recipient interacts with a telephone coupled to a telephone network, and the author interacts with a computer coupled to the telephone network through a data network. Input from the recipient may comprise telephone key depression or speech. The speech data may be directed to the telephone network through the data network. A notification may be transmitted to the author when the recipient is unable to connect with a telephone of the author, and the text data may be received in response to the notification message.

In other embodiments, the author may be defined as executable program code designed to generate text in response to input from the recipient. The individual may be selected based on attributes of the recipient, such as age or gender. The data representing the textual message may comprise a variable portion of a message having both a variable portion and a fixed portion, and it may further include the fixed portion. The fixed portion may be prerecorded speech of the individual or speech data previously converted from text data according to the various methods of the invention. The instant invention is also directed to pTTS systems that store prerecorded speech or previously converted speech data, and, as appropriate, in response to a request to generate speech data, combine the stored information with speech data converted in real-time from text data. The resultant speech date is then provided to a system user as audio output.

It is not intended that the invention be summarized here in its entirety. Rather, further features, aspects and advantages of the invention are set forth in or will be apparent from the following description and drawings.

DETAILED DESCRIPTION OF THE PREFERRED EMBODIMENTS

According to an embodiment of the present invention, a personalized text-to-speech (pTTS) system provides text-to-speech conversion for use with various services. These services, discussed in detail below, include, but are not limited to, speech announcements, film dubbing, Internet person-to-person spoken messaging, Internet chat room spoken text, spoken electronic mail, Internet shared spaces having objects intended for spoken presentation, and spoken notice of an incoming telephone call to a subscriber using the Internet.

Figure 1:
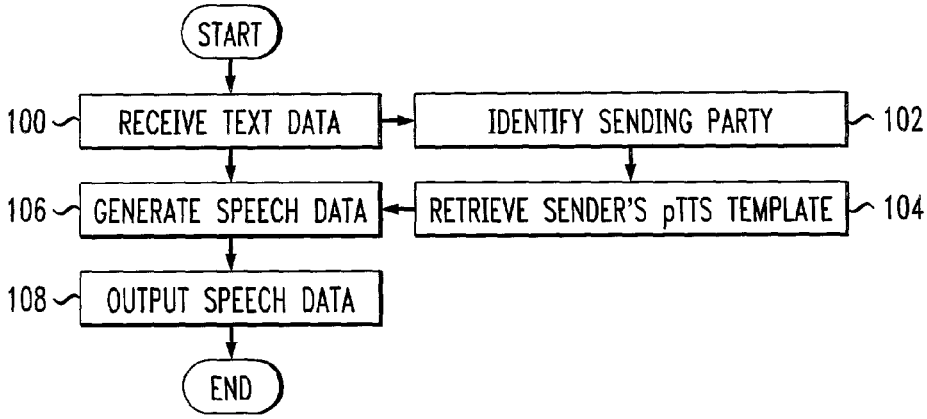
FIG. 1 is a flow chart illustrating an embodiment for a personalized text-to-speech (pTTS) system.

FIG. 1 is a flowchart representing an embodiment for a pTTS system. In step 100, the pTTS system receives text data directed from an author of the text data to an intended recipient. The text data is provided in a data format representing a generic text message, such as a text file or a word processing file. In one embodiment, the recipient may be a specific person or group of people. For example, the text data may be an e-mail message sent by the author. Alternatively, the recipient may be unknown to the author. For example, the author may post the text data on a web site for access by unspecified users.

In step 102, the pTTS system identifies the author of the text data for enabling identification of the proper pTTS template. In one embodiment, the pTTS system identifies the author using the author's e-mail address. Alternatively, the pTTS system requests confirmation of the author's identification by taking advantage of a user identification and/or password. In another alternative embodiment, the author's identification is transmitted with the text data in a predefined format. The identification step may additionally serve as an authentication or authorization step, to prevent unauthorized access to saved pTTS templates.

After the pTTS system identifies the author, the pTTS system retrieves a stored speech template associated with the author (step 104), referred to herein as the author's pTTS template. The author's pTTS template is a data file containing information representing voice characteristics of the author or voice characteristics selected by the author. Multiple pTTS templates are stored in the pTTS system for utilization by different users. In an alternative embodiment, the pTTS system provides the author with the option to generate a new pTTS template, using methods known in the art. In another alternative embodiment, an author has more than one pTTS template, representing different types of speech or different voice characteristics. For example, an author provides pTTS templates having speech characteristics corresponding to different languages. An author having multiple pTTS templates selects the appropriate pTTS template for the applicable text data. Alternatively, the author may have more than one user identification for accessing pTTS system, each associated with a different pTTS template.

After retrieving the author's pTTS template, the pTTS system generates speech data (step 106) corresponding to the text data. The pTTS system takes advantage of the author's pTTS template to generate the speech data in a format that may be audibly reproduced having voice characteristics represented by the selected template. For example, the speech data may be represented by data in the format of a standard ".wav" file. Thereafter, the speech data is output from the pTTS system (step 108), and transmitted to the appropriate destination.

Figure 2:
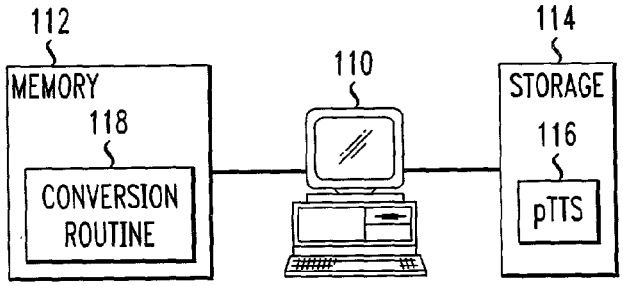
FIG. 2 is an illustration of a pTTS system embodied in a stand alone personal computer.

Referring to FIG. 2, stand alone personal computer 110 has memory 112 and storage 114, such as magnetic, optical, or magneto optical storage. Storage 114 includes at least one pTTS template 116. Personal computer 110 is programmed to select an appropriate pTTS template, which may be based on various factors, such as attributes of the author or recipient of the message. Conversion routine 118 executing in memory 112 accepts text data and converts the text data to speech data with pTTS template 116, following the procedure outlined in FIG. 1. The pTTS system may take advantage of different pTTS templates to output different sentences of text in different voices, thereby providing output in the form of a multi-person conversation. Personal computer 110 generates the sound corresponding to the speech data, thereby enabling a recipient interacting with personal computer 110 to hear the spoken message.

Figure 3:
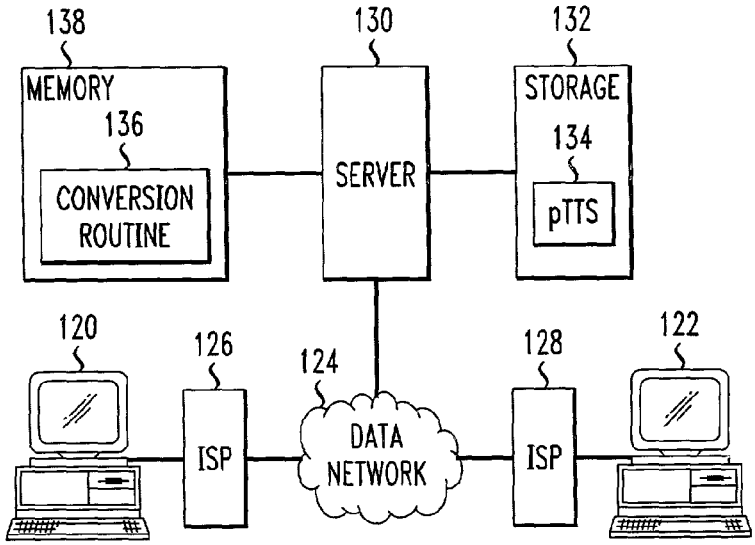
FIG. 3 is an illustration of a pTTS system wherein a pTTS template associated with an author of a text message is stored on a centralized server.

Referring to FIG. 3, an embodiment includes an author of a text message interacting with a first computer 120, and an intended recipient of the message interacting with a second computer 122. Computers 120 and 122 are coupled to data network 124 through Internet service provider 126 and Internet service provider 128, respectively. In alternative embodiments, the data network may comprise the Internet, a company's internal data network, or a combination of several networks.

Server 130 couples to data network 124. Server 130 is a general purpose computer programmed to function as a web site. Server 130 also couples to storage device 132, such as a magnetic, optical, or magneto-optical storage device. Storage device 132 stores a pTTS template 134 associated with the author, and may additionally store pTTS templates associated with other users. In an alternative embodiment, computer 120 transmits the author's pTTS template 134 to server 130 each time pTTS template 134 is needed, rather than storing pTTS template 134 on storage device 132.

The author interacting with computer 120 generates text data intended for the recipient interacting with computer 122. Rather than transmitting the text data directly to computer 122, the text data is directed through data network 124 to server 130 for conversion to speech data. Conversion routine 136, executing in memory 138 or server 130, accepts the text data and converts the text data to speech data with the author's pTTS template 134, using the process described in FIG. 1. The speech data thus contains information representing the voice characteristics of the author's speech template. Server 130 thereafter directs the speech data to computer 122. Server 130 may also send the original text data to computer 122, if desired. The recipient may listen to the speech message corresponding to the original text message with software executing on computer 122, in the author's own voice or a voice selected by the author.

In an alternative embodiment, computer 120 sends the text file directly to computer 122 through data network 124. Computer 120 provides the necessary information for accessing the author's pTTS template 134 stored on storage 132 of server 130 to computer 122, thereby allowing the recipient to obtain speech data having characteristics of the author's voice. The recipient interacting with computer 122 submits the text data to server 130 through data network 124, for conversion to speech data with conversion routine 136 and the author's pTTS template 134. Server 130 thereafter directs the speech data back to computer 122 for access by the recipient.

In another alternative embodiment, the text message is sent from computer 120 to server 130. After converting the text data to speech data with conversion routine 136 and the author's pTTS template 134, server 130 returns the resulting speech data back to computer 120. Computer 120 sends the speech data directly to computer 122 through data network 124.

Figure 4:
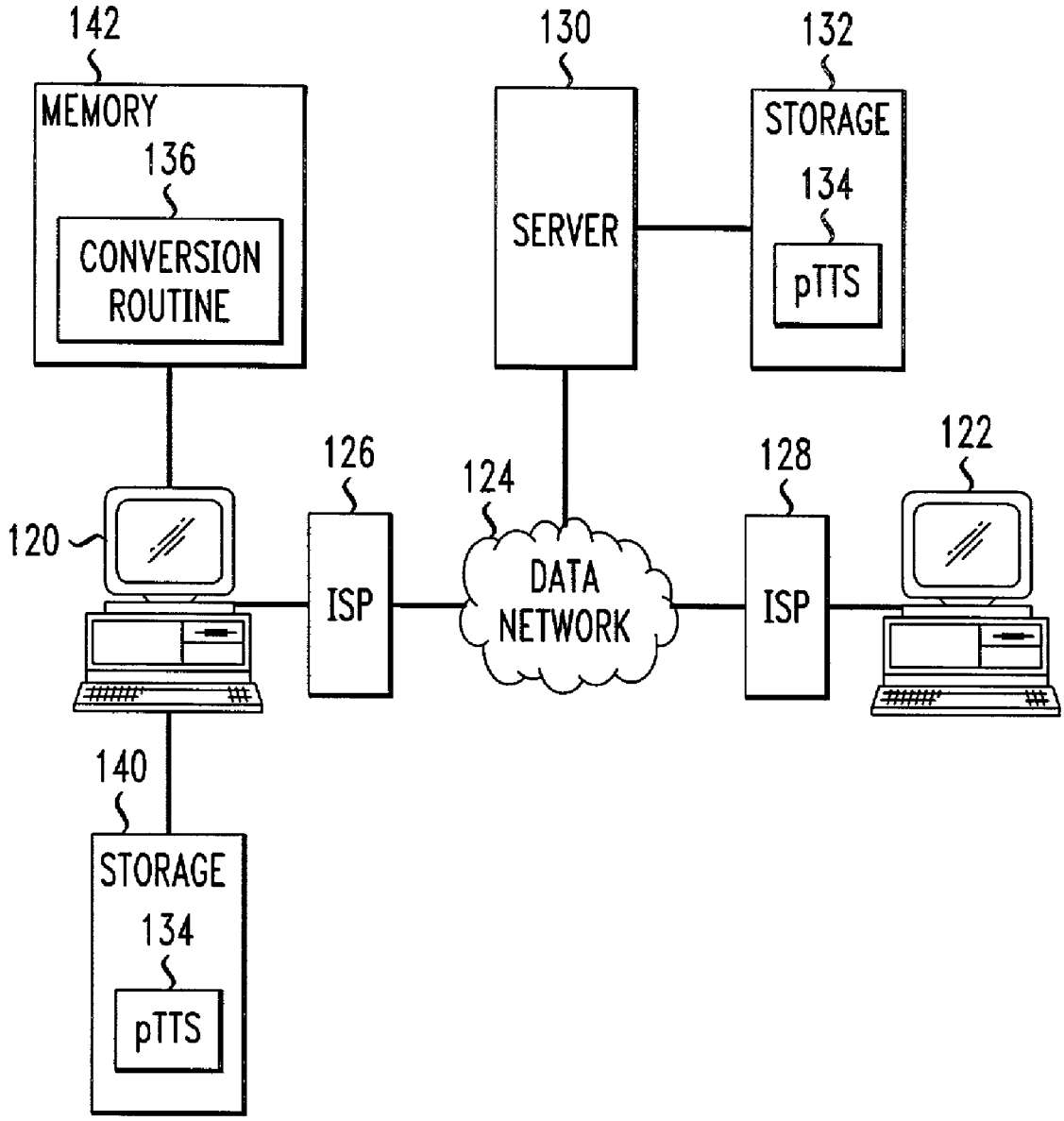
FIG. 4 is an illustration of a pTTS system wherein a pTTS template associated with an author of a text message is stored on the author's computer.

Referring to FIG. 4, in an alternative embodiment, storage device 140 coupled to computer 120 stores the author's pTTS template 134. Alternatively, computer 120 downloads the author's pTTS template 134 from server 130 when necessary for conversion of text to speech. Conversion routine 136 executes in memory 142 of computer 120, for conversion of text data from the author into speech data. Therefore, computer 120 sends the speech data directly to computer 122.

Figure 5:
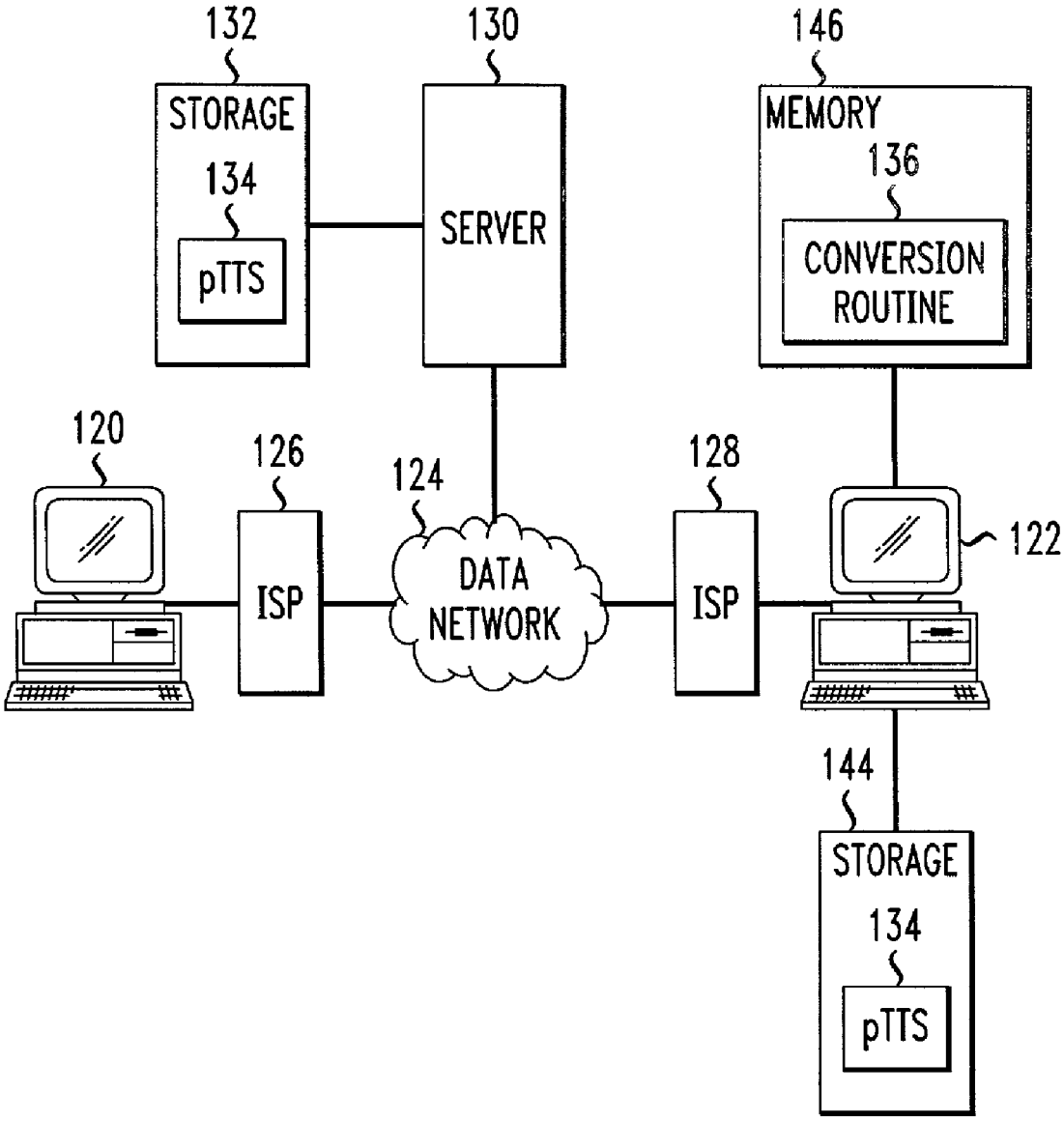
FIG. 5 is an illustration of a pTTS system wherein a pTTS template associated with an author of a text message is stored on a recipient's computer.

Referring to FIG. 5, in an alternative embodiment, storage device 144 coupled to computer 122 stores the author's pTTS template 134. Computer 120 separately sends the author's pTTS template 134 to computer 122. Alternatively, computer 122 downloads the author's pTTS template 134 from server 130. Conversion routine 136 executes in memory 146 of computer 122, for converting text data received from computer 120 into speech data. Therefore, computer 120 simply sends the text data to computer 122, which computer 122 converts to speech data if desired.

Figure 6:
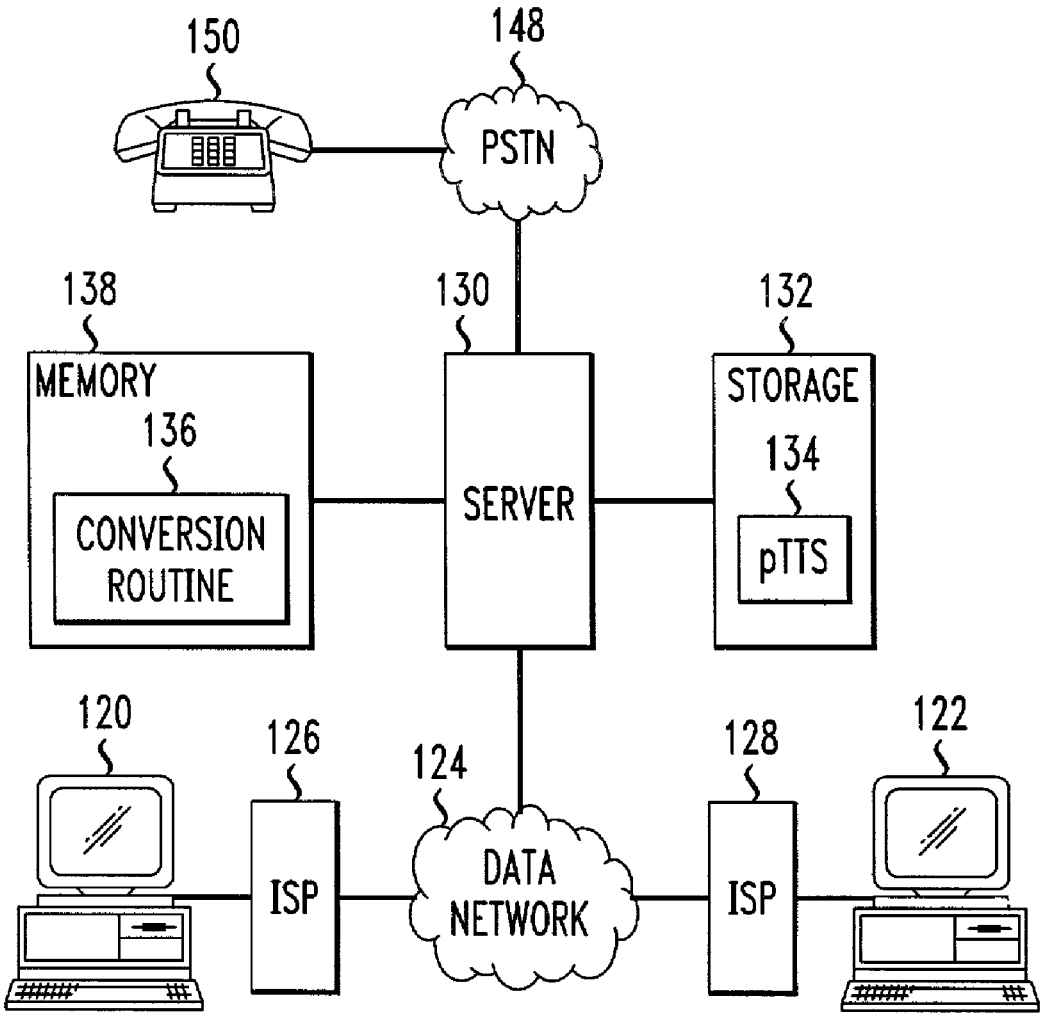
FIG. 6 is an illustration of a pTTS system wherein the server is coupled to a public switched telephone network.

Referring to FIG. 6, in an alternative embodiment, server 130 is further coupled to public switched telephone network (PSTN) 148. Telephone 150 is also coupled to PSTN 148. In one embodiment, PSTN 148 operates in a circuit switched manner, whereas data network 124 operates in a packet switched manner.

The embodiments illustrated herein describe computers coupled to a data network or coupled together through a data network. Coupling is defined herein as the ability to share information, either in real-time or asynchronously. Coupling includes any form of connection, either by wire or by means of electromagnetic or optical communications, and does not require that both computers are connected with the network at the same time. For example, a first and second computer are coupled together if a first computer accesses a network to send text data to an e-mail server, and the second computer retrieves such text data, or speech data associated therewith, after the first computer has physically disconnected from the network.

The pTTS system described herein may provide a wide array of individualized services. For example, personalized templates are submitted with text to a known text-to-speech algorithm, thereby producing individualized speech from generic text. Therefore, a user of the system may have a single pTTS template for use with text from a multitude of sources. Some of the uses of the pTTS system are discussed below.

Speech Announcements

In one embodiment, personal computer 110 of FIG. 2 is configured to operate as a voice response system. For example, personal computer 110 is placed at a kiosk, and provides spoken delivery of stored information. As another example, personal computer 110 is coupled to the PSTN and configured to operate as a voice response system in response to user input provided via telephone key depression or speech. Voice response software is well-known. Examples of voice response systems are described by U.S. Pat. No. 6,014,428, entitled "Voice Templates For Interactive Voice Mail And Voice Response System", and U.S. Pat. No. 5,125,024, entitled "Voice Response Unit", which are hereby incorporated by reference.

According to the present technique, the voice response software of personal computer 110 includes conversion routine 118, which is configured to use a pTTS template stored on storage 114. In one embodiment, the pTTS template represents the voice characteristics of the author. Alternatively, the pTTS template represents voice characteristics selected by the author or the provider of the voice response system. For example, the system may select a pTTS template representing voice characteristics of a person similar to the user of the system, for example of the same gender or of a similar age. Alternatively, the system selects a pTTS template predicted to elicit a certain response from the user, which may be based on marketing or psychological studies. Alternatively, the system allows the user to select which pTTS template to use.

The voice response system converts variable text messages to speech with a pTTS template. Some messages may contain both a variable portion and a fixed portion. One example of such message is "Your account balance is xx dollars and yy cents", where "xx" and "yy" are variable numerical values. In one embodiment, the entire text message comprising both the variable and fixed portions is submitted to the pTTS system for conversion to speech data. Alternatively, the fixed portions are prerecorded speech, and only the variable portions are submitted as text to the speech system for conversion to speech data using the same voice that recorded the fixed portion of the message. A single audible message may be output by merging the prerecorded speech and generated speech data. In another embodiment, the entire text message is fixed text. Submitting such text to the pTTS system allows selecting the desired pTTS template based upon the factors as described above.

Film Dubbing

In another embodiment, personal computer 110 of FIG. 2 is configured to operate as part of a film editing system. Specifically, personal computer 110 operates to dub voices for films with foreign language subtitles. The pTTS templates of the actors are stored in storage 114, and used to produce speech data corresponding to the subtitles, thereby creating a multi-lingual soundtrack. In one embodiment, the lines of the actors are stored in a text file. An electronic code precedes each actor's lines, thereby identifying each portion of text with the correct actor. The code enables conversion routine 118 to select the correct pTTS template 116 associated with the actor speaking a particular set of lines. The actors may need to produce different templates for each language, due to the different pronunciation characteristics of words in different languages. Timing information may be included in the text file to aid in the production of speech data that is properly synchronized with the film. In an alternative embodiment, a person's pTTS template may be used for different animated characters in animated films.

Person-To-Person Spoken Messaging

In an alternative embodiment, computer 120 and computer 122 are each configured with software for exchanging typed messages over data network 124, in a so-called "instant message" format. Software that enables personal computers to exchange messages in this manner is well known.

In the configuration shown in FIG. 3, the author types a text message using computer 120 for delivery to computer 122. However, rather than sending the message directly to computer 122, computer 120 directs the message through data network 124 to server 130. Conversion routine 136 executing in memory 138 of server 130 converts the text data to speech data, using the author's pTTS template 134, stored on storage 132. Server 130 thereafter directs the speech data to computer 122. A person interacting with computer 122 may also act as the initiator of a message, in which case such person's pTTS template is also stored on storage 132 of server 130. Messages directed to computer 120 are first directed to server 130 for conversion to speech data using the appropriate pTTS template.

In the configuration shown in FIG. 4, the author types a text message using computer 120 for delivery to computer 122. However, rather than sending the text message to a centralized server, the message is converted to speech data by conversion routine 136 executing in memory 142 of computer 120. The author's pTTS template 134 is stored on storage 140 of computer 120, for access by conversion routine 136. Therefore, computer 120 sends the speech data directly to computer 122 through data network 124. A person interacting with computer 122 may also act as the initiator of a message, in which case the message is converted to speech data by the conversion routine executing in memory of computer 122, using the appropriate pTTS template.

In the configuration shown in FIG. 5, the author types a text message using computer 120, which is sent directly to computer 122 through data network 124. The author's pTTS template 134 is stored on storage 144 of computer 122. Therefore, conversion routine 136 executing in memory 146 of computer 122 converts the text data to speech data. Alternatively, computer 122 may direct the text data to server 130 for conversion to speech data using the author's pTTS template 134 on storage 132 of server 130. Server 130 then redirects the speech data back to computer 122. As in the other configurations, a person interacting with computer 122 may also act as the initiator of the message.

Chat Room Spoken Text

In an alternative embodiment, server 130 is operative to execute so-called Chat software. In general, the Chat software enables a user to "enter" a chat room, view messages input by other users who are in the chat room, and to type messages for display to all other users in the chat room. The set of users in the chat room varies as users enter or leave.

Each Chat implementation architecture provides a Chat Client program and a Chat Server program. The Chat Client program allows the user to input information and control which Chat Client users will receive such information. Chat Client user groupings, which may be referred to as chat rooms or worlds, are the basis of the user control. A user controls which Chat users will receive the typed information by becoming a member of the group that contains the target users. A Chat user becomes a member of a group by executing a Chat Client "join group" function. This function registers the Client's internet protocol (IP) address with the Chat Server as a member of that group. Once registered, the Client can send and receive information with all the other Clients in that group via the Chat Server. The exchange of information between the Clients and Server is based on the "Internet Relay Chat" (IRC) protocol running over separate input and output ports.

Figure 7:
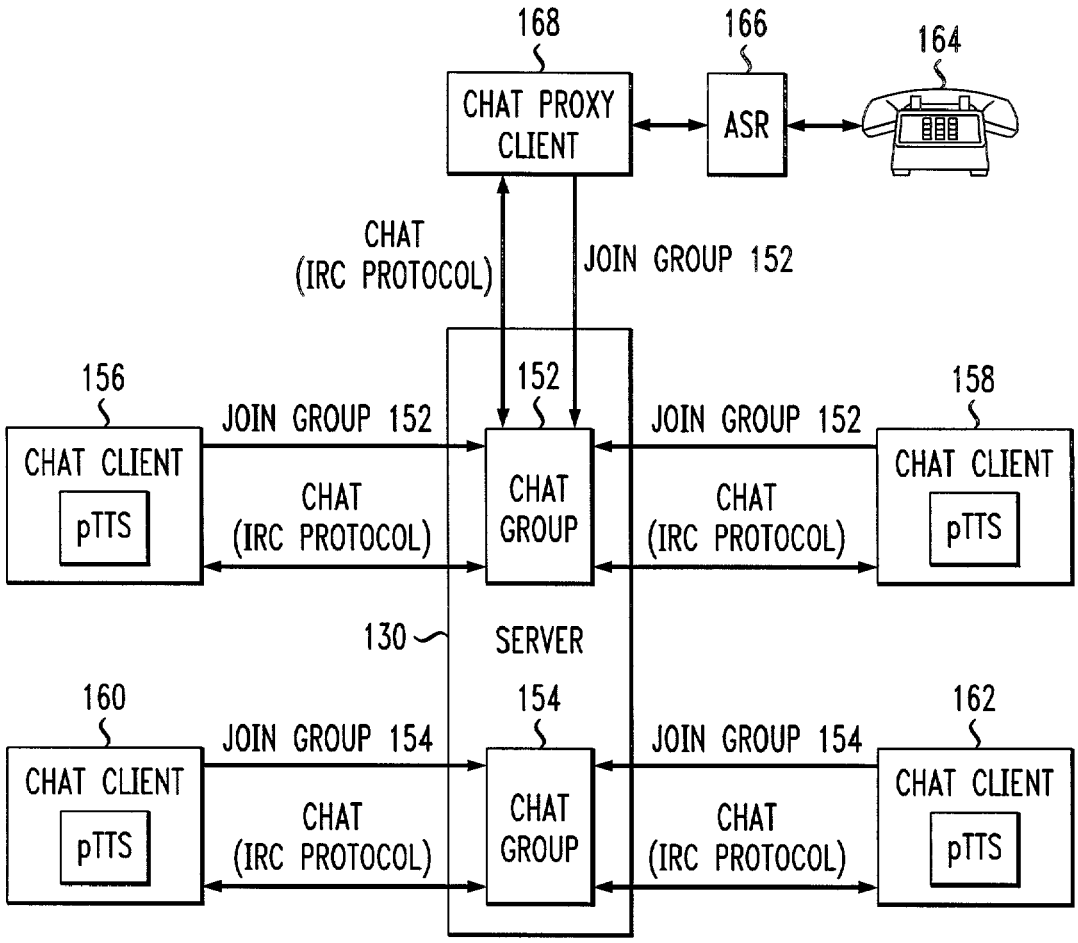
FIG. 7 is an illustration of a Chat implementation architecture.

FIG. 7 illustrates a chat implementation architecture. Server 130 supports chat group 152 and chat group 154. Other chat groups may be added. Users interacting through chat client 156 and chat client 158 join chat group 152, and thereafter may communicate through chat group 152 with the IRC protocol. Similarly, users interacting through chat client 160 and 162 join chat group 154, and thereafter may communicate through chat group 154 with the IRC protocol.

According to the present technique, at least one user in the chat room has access to a computer operative to generate speech with the user's pTTS template.

In the configuration shown in FIG. 3, server 130 acts as the chat room. Storage 132 stores the pTTS templates for each user in the chat room. A user's pTTS template is transferred to server 130 when the user signs in to the chat room. Server 130 stores the pTTS templates of frequent users, to avoid the necessity of submitting the pTTS template each time a user signs in. Thereafter, as each user submits text data to the chat room, conversion routine 136 executing in memory 138 of server 130 converts the text data to speech data using the submitter's pTTS template. Therefore, each user can access messages from other users having the voice characteristics of the corresponding user. The server may also provide text messages, in the event that some users do not provide a pTTS template. The personalized speech may be delivered as an audio file in ".wav" format or other suitable format. Alternatively, the personalized speech may be delivered from server 130 as streaming audio.

In the configuration shown in FIG. 4, server 130 acts as the chat room. However, the pTTS template 134 of each user is stored on storage 140 of the user's computer 120. In an alternative embodiment, the user's pTTS template 134 is downloaded from server 130 as the user enters the chat room. As the user leaves the chat room, server 130 notifies the user's computer 120 that the pTTS template is no longer needed, so that it may be deleted from storage 140. Each user, therefore, sends speech data directly to the chat room, as opposed to text data.

In the configuration shown in FIG. 5, server 130 acts as the chat room. Server 130 stores the pTTS template of each user in storage 132. When a user enters the chat room, the user downloads the pTTS templates of each user in the chat room, and stores the pTTS templates on storage 144 of the user's computer 122. Messages are submitted to server 130 in text format, and read by the user's computer 122 in text format. However, when computer 122 receives messages typed by another user in the chat room, such as a user interacting with computer 120, computer 122 generates speech corresponding to the text of the message using the author's pTTS template 134 stored on storage 144.

In an alternative embodiment, personalized speech is delivered to a telephone-only participant in the chat room, interacting through telephone 164. Automated speech recognition (ASR) functions 166 and pTTS functions interface with the standard Chat architecture via Chat Proxy 168. Chat Proxy 168 establishes the Chat session with the Chat Server, joins the appropriate group, and establishes an input session with ASR 166 and an output session with the pTTS functions. ASR 166 converts the phone speech to text and sends the output to Chat Proxy 168. Chat Proxy 168 takes the text stream from ASR 166 and delivers it to the Chat Server input port using IRC. Chat Proxy 168 also converts the IRC stream from the Chat Server output port into the original typed text and delivers it to the pTTS function where the text is played to the phone user in the Chat Client user's voice.

Spoken Electronic Mail

Electronic mail systems having a text-to-speech front-end that allows a user to retrieve their electronic mail using a telephone are known. However, in an embodiment of the present invention, a user may listen to electronic mail in the author's own voice. For example, a parent that is away from home may send an e-mail message to a child, who is then able to listen to the message in the parent's own voice.

Referring to FIG. 6, let it be assumed that the user of computer 120 composes an electronic mail message, indicates a preferred delivery time, and also indicates that it is to be delivered via speech to a particular telephone number, such as the telephone number associated with telephone 150. The user of computer 120 sends this message via ISP 126 and data network 124 to server 130. Server 130 stores the message in storage 132. At the preferred delivery time, server 130 retrieves the message from storage 132, and also retrieves the author's pTTS template 134 from storage 132. It will be appreciated by those skilled in the art that the message and the pTTS template may be stored on different storage devices. Server 130 uses the author's retrieved pTTS template 134 to generate speech corresponding to the retrieved message. Specifically, conversion routine 136 executing in memory 138 of server 130 converts the text message to speech data. Server 130 then places a telephone call using PSTN 148 to telephone 150 and delivers the personalized speech.

In an alternative embodiment, spoken electronic mail is implemented as person-to-person spoken messaging, as described above with reference to FIGS. 3-5.

Shared Space Objects

A "shared space" is a location on the Internet where members of a group can store objects, so that other members of the group can access those objects. A chat room is an example of a real-time shared space location, although a shared space provides additional flexibility by allowing storage of objects for future access. Such Internet hosting systems that allow users to upload objects and control object access are known.

In an embodiment of the present invention, a user creates an object and associates the user's pTTS template with the object. The object-pTTS template association may be to the object (text file), and/or an object description (text file describing the object). The user uploads the object and the user's associated pTTS template to the Internet site shared space. Thereafter, when another user with permission to access the shared object accesses that object, a pTTS enabler provides the user the option to hear the speech associated with the text. The pTTS enabler may be invoked automatically, or on demand. If the user selects to hear the message, a conversion routine converts the text data to speech data using the corresponding pTTS template.

In one embodiment, a shared space object comprises biographical information describing a user, in text format. Therefore, by converting the text data to speech data with the user's pTTS template, other users may hear the biographical description in the user's own voice. In other embodiments, shared space objects may include classified ads, resumes, personal web sites, or other personal information.

Spoken Telephone Call Notice

U.S. Pat. No. 5,805,587, the disclosure of which is hereby incorporated by reference, describes a facility to alert a subscriber whose telephone is connected to the Internet of a waiting call, the alert being delivered via the Internet. A waiting call is forwarded from the PSTN to a services platform that sends the alert to the subscriber via the Internet. If requested by the subscriber, the platform may then forward the telephone call to the subscriber via the Internet without interrupting the subscriber's Internet connection.

Referring to FIG. 6, the user of telephone 150 is assumed to be calling the user of computer 120. The user of computer 120 is assumed to have a telephone (not shown) that is not coupled to PSTN 148, because the user of computer 120 is instead using the telephone line to connect to ISP 126. Server 130 operates as the services platform described in U.S. Pat. No. 5,805,587, and delivers a message via data network 124 and ISP 126 to computer 120 that a call from telephone 150 is waiting. The user of computer 120 composes a textual message, or retrieves an already composed textual message, for delivery to the user of telephone 150, and sends the message from computer 120 via ISP 126 and data network 124 to server 130. Server 130 retrieves the pTTS template 134 for the user of computer 120 from storage 132, generates speech corresponding to the message using conversion routine 136 executing in memory 138, and delivers the personalized speech via PSTN 148 to telephone 150.

Personalized Speech For Software Applications

In another embodiment, personal computer 110 of FIG. 2 is configured to operate as a pTTS system in cooperation with a software application. The software application submits text data to conversion routine 118 executing in memory 112, for conversion to speech data. The speech data is output to a user as audio information through speakers coupled to personal computer 110. Conversion routine 118 operates as an independent program, which may be accessed by various software applications for conversion of text data to speech data. Alternatively, conversion routine 118 is integrated with the software application requiring text-to-speech services.

In one embodiment, the software application comprises a learning program that provides an interactive teaching session with a user. Learning programs providing pre-recorded audio output are known. However, the pTTS system provides personalized audio output in place of such pre-recorded audio. Specifically, the learning program submits text data to conversion routine 118, which converts the text data to speech data having characteristics of a specified voice. The pTTS system loads and applies a specific pTTS template to the text data so that the software/toy provides audio outputs from a teacher or a parent. The voice of a parent or teacher, thereby personalizes the learning experience.

In another embodiment, the text of a book or article is submitted to conversion routine 118 for conversion to speech data. A parent may include his or her speech template in storage 114, permitting a child to hear the book or article read in the parent's own voice, again perzonalizing the experience for the child.

In another embodiment, the pTTS system is implemented in a device such as a children's toy, which is capable of executing conversion routine 118 and storing pTTS template 116. A pTTS template is loaded into the device, thereby providing personalized speech output during operation of the toy.

Personalized Interactive Voice Recognition System

A pTTS system may also be operated on a computer in cooperation with a software application to provide a Personalized Interactive Voice Recognition System (Personalized IVR). IVRs utilize voice prompts to request that a caller provide certain information at appropriate times. The caller responds to the request by inputting information via key selections, tones or words. Depending on the information input, subsequent prompts request additional information and/or provide status feedback (e.g., "please enter your identification number" or "please wait while we connect your call"). The request prompts of a Personalized IVR system comprise a prompt script. In alternative embodiments of the Personalized IVR system, the prompt script may contain portions that are fixed and/or variable portions that are formulated just prior to a request for information.

Figure 8:
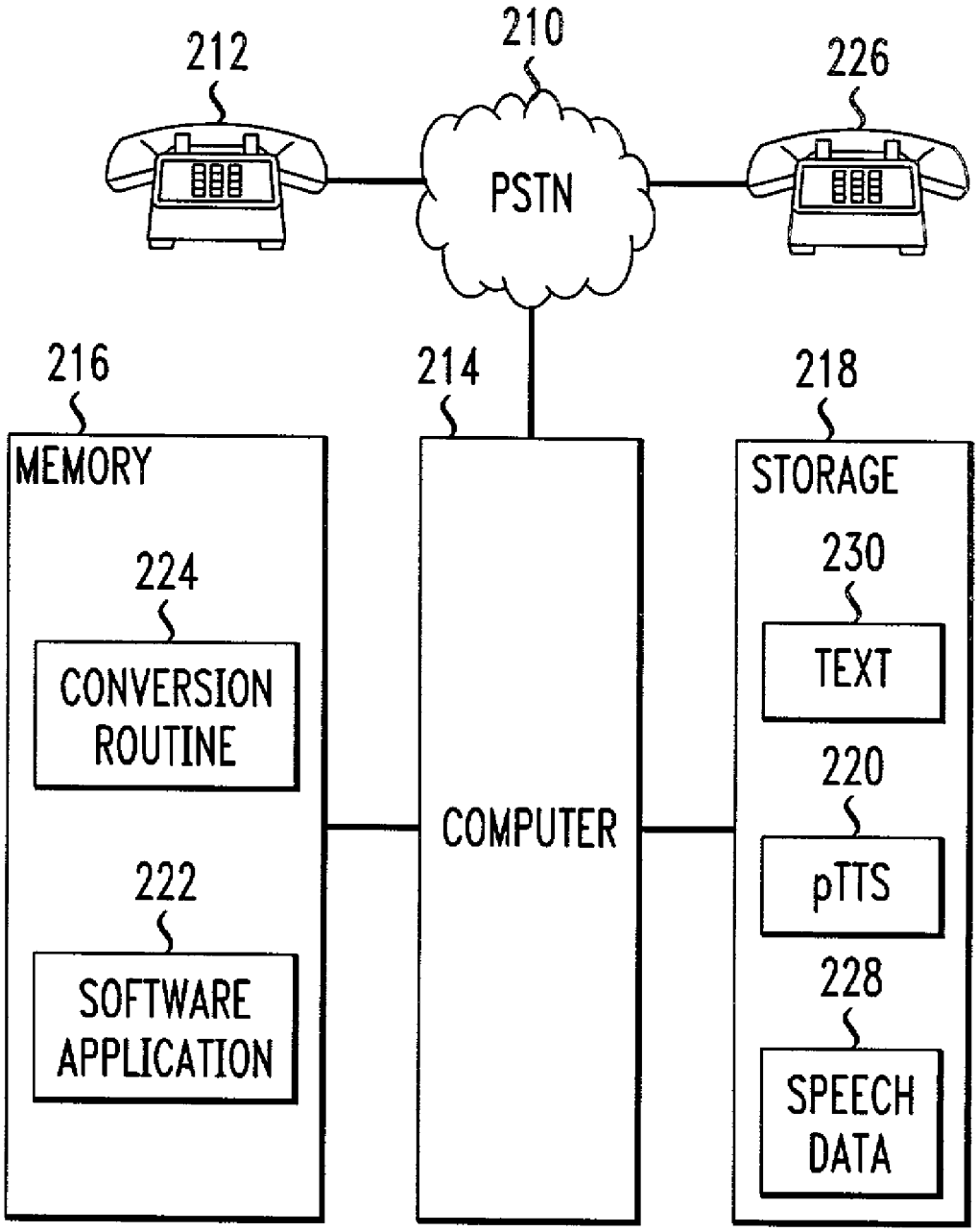
FIG. 8 is an illustration of a provisioning pTTS system embodied in a stand alone personal computer.

FIG. 8 illustrates a Personalized IVR system in which the PSTN 210 links with a first telephone 212 and a computer 214. The computer 214 has memory 216 and storage 218, which includes at least one pTTS template 220. Computer 214 is programmed to select an appropriate pTTS template, based on various factors, such as attributes of the author (i.e., creator of the personalized pTTS template associated with the called telephone number) and/or recipient of the message. Software application 222 executes in memory 216 in conjunction with conversion routine 224, which accepts text data and converts the text data to speech data with pTTS template 220, following the procedure outlined in FIG. 1. Computer 214 generates audio output corresponding to the speech data, thereby enabling a recipient interacting via telephone 212 with computer 214 to hear spoken messages. The recipient of the audio output at the first telephone 212 may be forwarded to a second telephone 226 for interaction with an actual individual after a chosen level of information has been provided to the Personalized IVR system. Naturally, the telephones of the Personalized IVR system may comprise one of several equivalent devices that provide electronic communication between distant parties. For example, a telephone may comprise a traditional handheld device with a speaker or transmitter and a receiver. Alternatively, a telephone may comprise a computer or similar device equipped with a telephony application program interface (i.e., telephony API).

The pTTS system may take advantage of different pTTS templates to output one of a plurality of voices and may later forward a caller to the individual assistance operator corresponding to the pTTS template and possessing the voice of the audio output utilized during the earlier part of the recipient's interaction with the pTTS system. In this manner, the intake of information from a caller may proceed seamlessly, with the caller not being readily aware of the transition from the Personalize IVR system to an actual assistance operator.

The Personalized IVR systems applies the pTTS system to personalize the voice of the audio output providing the prompt script to a caller. That is, given a prompt script, the pTTS template is applied to the prompt script to create personalized audio outputs. Thus, a caller may be prompted by audio output in a familiar voice or in a voice selected to elicit desired responses. Such a Personalized IVR system can be supplied as part of a home-messaging system by a telecommunications service provider.

Applications with Real Time and Provisioning Capabilities

In all of the above described embodiments, the pTTS system may be fashioned to operate with "real time" and/or "non-real-time" text-to-speech conversion of the prompt script. In embodiments utilizing real-time conversion of the prompt script, the pTTS system is invoked only to convert the text data necessary to provide the next audio output in response to the most recent user input. Based on a caller/user input, the appropriate text response to the caller input is determined and forwarded to the pTTS system. The pTTS system identifies the sending party, retrieves the sender's pTTS template and generates speech data corresponding to the forwarded text response. The speech data is then output to the caller/user to elicit a response (i.e., the next input to the pTTS system). This process of receiving input and determining and generating output repeats until the interaction of the user with the pTTS system is concluded (see FIG. 1). For example, the Personalized IVR system operates in "real time", applying the pTTS template only to the portion of the prompt script needed to generate an audio output response to the last input of the caller. In Personalized Speech For Software Applications embodiments, text data for the next user sequence in the software application is submitted to the conversion routine 118 of the pTTS system executing in memory 112, for immediate conversion to speech data and output to a user.

However, in order to avoid repeated conversion of portions of the prompt script, the pTTS system may be equipped with storage for speech data that has been converted from text data by the conversion routine. For example, the storage 218 of the Personalized IVR system of FIG. 8 may be augmented with storage for speech data 228 that will be used repeatedly, such as a welcome greeting. This storage provided by the Personalized IVR system may be capable of storing the audio output of the entire prompt script. Similarly, other of the above described embodiments incorporating the pTTS system may be equipped with storage for speech data that has been converted from text data.

In such a way, embodiments of pTTS systems incorporating provisioning features may be provided. Provisioning pTTS systems convert a substantial portion of the prompt script at one time and store the converted audio output for later use. It is given that a prompt script may contain portions that are fixed and portions that are variable and formulated just prior to an information request. In addition, some of the fixed portions of the prompt script may be utilized repeatedly by any one pTTS system embodiment. Therefore, use of a provisioning pTTS system reduces the computing power necessary to run the system during individual user interactions, consequently reducing the delivery time for audio output provided to the user.

For instance, to provide an interactive game with provisioning capabilities, the storage 114 of the pTTS embodiment described in FIG. 2 may be augmented to include storage for the speech data corresponding to at least a portion of the prompt script. Once an author has provided a pTTS template using methods know in the art, the author may provision the pTTS system, selecting that the system convert the fixed portions of the prompt script for later use.

The provisioning of the pTTS system is accomplished in a manner similar to the method described with respect of FIG. 1, with the exception that the output speech data of step 108 is stored to a speech data area of storage for each of the many fixed portions of the prompt script. The speech data may be stored in any of a variety of formats. For example, the speech data for each fixed portion of the prompt script may comprise a separate .wav file. In addition, the pTTS system may be provisioned with the speech data of multiple authors. Accordingly, the stored speech data is accessible via various indicies, such as author and the text of data converted of speech data.

Figure 9:
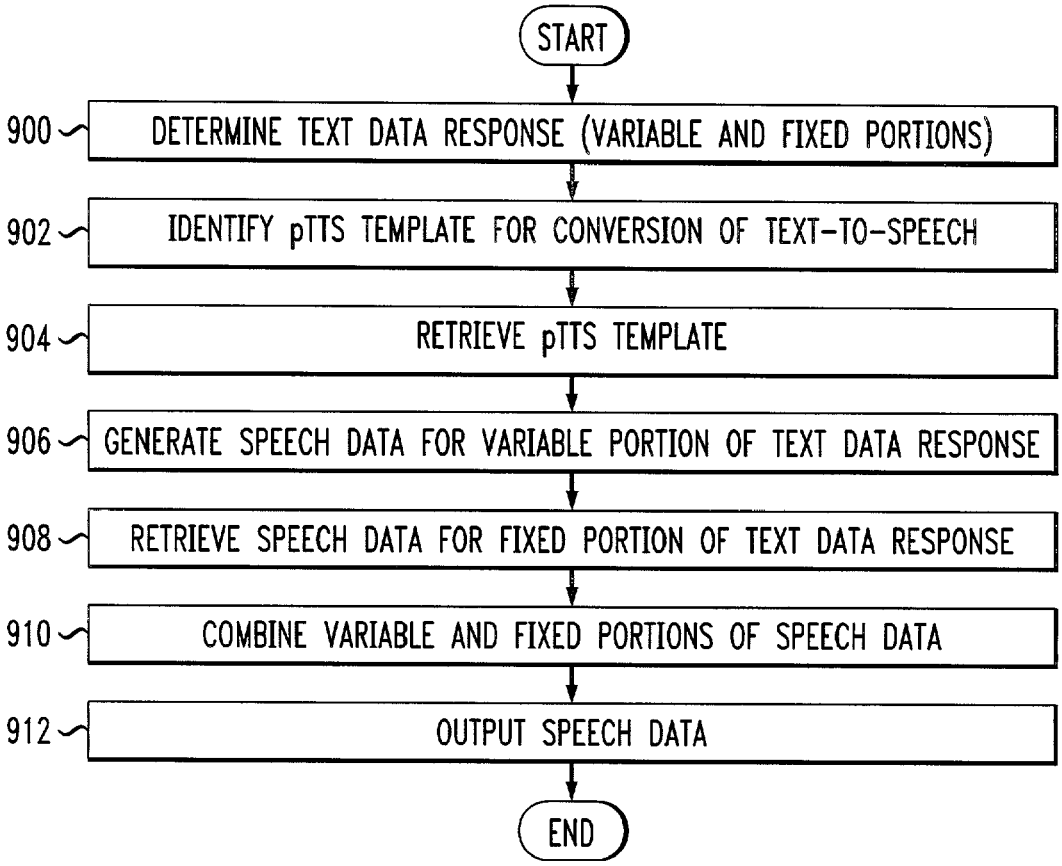
FIG. 9 is a flow chart illustrating an embodiment for a provisioning pTTS system.

The operation of a provisioning pTTS embodiment, after its has been provisioned, is illustrated in the flowchart of FIG. 9. In step 900, the pTTS system determines the text data response, including variable and fixed portions of the prompt script, intended for a recipient in response to an input. The text data for the response is provided in a data format representing a generic text message, such as a text file or a word processing file. In step 902, the pTTS system identifies the proper pTTS template to utilize for the text-to-speech conversion of the variable portion of the text data response. The proper pTTS template, which represents the voice characteristics that are to be provided to the recipient, may be identified by a toggle switch or programmable entry in the pTTS system. The pTTS system retrieves the proper stored speech template associated with the author (step 904), referred to herein as the author's pTTS template. In the case of a child's interactive game, the pTTS template may characterize the voice of a parent, sibling, teacher, coach or other individual. After retrieving the author's pTTS template, the pTTS system generates speech data (step 906) corresponding to the variable portion of the text data response necessary to provide immediate output to the user. At step 908, the pTTS system determines the speech data for the fixed portion of the text data response necessary to provide immediate output to the user. This step involves a lookup of stored speech data using an appropriate index. The pTTS system then combines the speech data for the variable and fixed portions of the text data response necessary to provide immediate output to the user in step 910. Once or as the variable and fixed portions of the text data response have been combined, the resultant speech data is output from the pTTS system (step 912) and provided to the user.

Although illustrative embodiments of the present invention and various modifications thereof have been described in detail herein with reference to the accompanying drawings, it is to be understood that the invention is not limited to these precise embodiment and the described modifications, and that various changes and further modifications may be effected therein by one skilled in the art without departing from the scope or spirit of the invention as defined in the appended claims.

The invention claimed is:

1. A computer-implemented method for converting text to speech comprising:

providing fixed text data comprising a fixed textual message;

retrieving a speech template from a plurality of speech templates based on an attribute that identifies the speech template, the speech template comprising information representing characteristics of an individual's voice;

converting the fixed text data to fixed speech data, the fixed speech data comprising a spoken form of the fixed text data having the characteristics of the individual's voice;

storing the fixed speech data; and retrieving the stored fixed speech data in presenting speech to a user.

2. A method according to claim 1 further comprising:

determining a first portion of the fixed text data that is an appropriate response to an input;

accessing from storage a first portion of the fixed speech data corresponding to the first portion of the fixed text data; and providing the first portion of the fixed speech data to a recipient.

3. A method according to claim 2 further comprising:

determining variable text data comprising a variable textual message that is an appropriate response to the input;

retrieving the speech template;

converting the variable text data to variable speech data, the variable speech data comprising a spoken form of the variable text data having the characteristics of the individual's voice; and providing the variable speech data to a recipient.

4. The method according to claim 3 wherein the step of determining variable text data comprises:

generating a contextual response to the input.

5. The method according to claim 2 wherein:

the attribute is an identifier of the recipient or an author.

6. The method according to claim 2 wherein the input comprises:

a key depression or a spoken utterance.

7. The method according to claim 2 further comprising:

selecting the first portion of fixed speech data from a plurality of fixed speech datas based on an attribute of the recipient, each of the plurality of fixed speech datas having characteristics of a unique individual's voice.

8. The method according to claim 7 wherein the attribute is age or gender.

9. The method according to claim 1 wherein the speech template represents the characteristics of the voice of a parent, sibling, relative, teacher or friend of the recipient.

10. The method according to claim 9 wherein the recipient interacts with a telephone or telephone API equipped device coupled across a telephone network to a computer.

11. The method according to claim 9 wherein the step of providing the speech data comprises:

directing the speech data within a telephone network or a data network.

12. The method according to claim 1 further comprising:

providing the speech data to a recipient.

13. The method according to claim 1 wherein the fixed text data comprises an e-mail message or a manuscript text.

14. The method according to claim 1 further comprising:

receiving a speech template for an individual.

15. The method according to claim 1 further comprising:

receiving a voice sample from an individual; and generating a speech template for the individual based on the voice sample.

16. A text to speech conversion system comprising:

a memory that stores executable program code;

a processor that executes the program code;

a storage device that stores a speech template and speech data, the speech template comprising information representing characteristics of an individual's voice, the speech data comprising information representing a spoken form of text data having the characteristics of the individual's voice, wherein the program code is executable to convert the text data to the speech data, the text data representing a textual message that is generated by an author for a recipient, where the recipient interacts with a telephone coupled to a telephone network and the author interacts with a computer coupled to the telephone network through a data network; and notification program code designed to transmit a notification to the author when the recipient is unable to connect with a telephone of the author.

17. The system according to claim 16 wherein the text data comprises a textual message in response to the notification message.

18. The system according to claim 16 wherein the text data comprises an e-mail message or a manuscript text.

19. A method for converting text to speech comprising:

storing a plurality of speech templates, each speech template comprising information representing characteristics of a unique voice;

receiving a prompt script;

converting the prompt script to fixed speech data using each of the plurality of speech templates, the fixed speech data representing a spoken form of the prompt script;

receiving text data including variable text data and fixed text data from an individual;

retrieving one of the plurality of speech templates associated with the individual;

converting the variable text data to variable speech data, the variable speech data representing a spoken form of the variable text data;

retrieving fixed speech data corresponding to the fixed text data; and providing the fixed speech data and the variable speech data to a recipient.

20. A method for converting text to speech comprising:

providing fixed speech data for a first individual;

determining a text data response intended for a recipient in response to an input, the text data response including a variable text data portion and a fixed text data portion;

identifying a first speech template representing voice characteristics of the first individual;

generating variable speech data using the first speech template, the variable speech data corresponding to the variable text data portion;

determining a portion of the fixed speech data corresponding to the fixed text data portion; and providing the variable speech data and the portion of the fixed speech data to the recipient.

21. The method of claim 20 wherein the step of providing fixed speech data comprises:

providing the first speech template for the first individual;

providing the fixed text data portion of a prompt script;

generating fixed speech data corresponding to the prompt script using the first speech template; and storing the fixed speech data that has been generated.

22. The method according to claim 20 wherein the step of determining a text data response comprises:

generating the text data response in response to the input.

23. The method according to claim 20 wherein the step of determining a text data response comprises:

identifying the input; and accessing a memory containing a prompt script utilizing at least a part of the input to identify the text data response corresponding to the input.

24. The method according to claim 20 wherein the text data response comprises an e-mail message or a manuscript text 25. The method according to claim 20 wherein the input comprises;

a key depression or a spoken utterance.

26. The method according to claim 20 further comprising:

selecting the first speech template based on an attribute of the recipient.

27. The method according to claim 26 wherein the attribute is age or gender.

28. The method according to claim 20 wherein the first speech template represents the voice characteristics of a parent, sibling, relative, teacher or friend of the recipient.

29. The method according to claim 20 wherein the step of determining a portion of the speech data corresponding to the fixed text data portion comprises:

accessing a memory holding the fixed speech data using an index.

30. The method according to claim 20 wherein the step of determining a portion of the fixed speech data corresponding to the fixed text data portion comprises:

identifying the input; and accessing a memory containing the fixed speech data utilizing at least a part of the input to identifying the portion of the fixed speech data.

31. The method according to claim 20 wherein the step of providing the variable speech data and the portion of the fixed speech data comprises:

directing the speech data within a telephone network or a data network.

32. The method according to claim 20 wherein the recipient interacts with a telephone or a telephone API equipped device coupled across a telephone network to a computer.

33. The method according to claim 20 wherein the step of providing the variable speech data and the portion of the fixed speech data comprises:

outputting a speech data in an audio form.

34. The method according to claim 20 further comprising:

receiving the first speech template for the first individual; and storing the first speech template in a memory.

35. The method according to claim 20 further comprising:

combining the variable speech data and the portion of the fixed speech data into a resultant speech data prior to providing resultant speech data to the recipient.

36. The method of claim 20 wherein fixed speech data is provided for a plurality of individuals and a plurality of speech templates are provided, and further comprising:

identifying one of the plurality of individuals as the first individual and one of the plurality of speech templates as the first speech template according to a toggle switch or programmable entry.

* * * * *